US005108232A

United States Patent [19]

Strassil

[11] Patent Number: 5,108,232

[45] Date of Patent: Apr. 28, 1992

[54] STRUCTURE TO CONTAIN NATURAL AND/OR ARTIFICIAL EMBANKMENTS

[75] Inventor: Carlo Strassil, Rome, Italy

[73] Assignee: C.R.A. Centro Ricerche Applicate S.p.A., Rome, Italy

[21] Appl. No.: 647,772

[22] Filed: Jan. 30, 1991

[30] Foreign Application Priority Data

Feb. 28, 1990 [IT] Italy ..... 47689 A/90

[51] Int. Cl.[5] ..... E02D 29/02

[52] U.S. Cl. ..... 405/286; 405/273; 405/284

[58] Field of Search ..... 405/258, 262, 272, 273, 405/284, 285, 286, 287

[56] References Cited

U.S. PATENT DOCUMENTS

| | | | |
|---|---|---|---|
| 3,990,250 | 11/1976 | Howard | 405/287 |
| 4,190,384 | 2/1980 | Neumann | 405/284 |
| 4,521,138 | 6/1985 | Steiner | 405/284 |
| 4,664,562 | 5/1987 | Clark et al. | 405/273 |
| 4,671,706 | 6/1987 | Giardini | 405/286 |
| 4,684,294 | 8/1987 | O'Neill | 405/286 |
| 4,815,897 | 3/1989 | Risi et al. | 405/286 |

*Primary Examiner*—David H. Corbin
*Attorney, Agent, or Firm*—Joseph W. Farley

[57] ABSTRACT

A structure for the containment of natural and/or artificial embankments, said structure being made up of a plurality of modular envelopes (1), each one of said envelopes (1) being made up of a tub-like fore member (2), whose fore wall (5) is at a slope with respect to the vertical direction; as well as of two transverse members (4) which are provided with fore hammer-like members (8, 9), i.e., lower and upper hammer-like members, which members couple with a suitable seat (7) obtained in the side walls (6) of said tube-like member (2) belonging to the same envelope (1) and to that in the adjacent position; and of a back longitudinal member (3) that bears on its side ends hammer-like members (12, 13) for realizing the coupling with corresponding hammer-like members (10, 11) provided at the back position on the transverse members (4) of the envelope (1) to which it belongs or of the upper envelope.

10 Claims, 3 Drawing Sheets

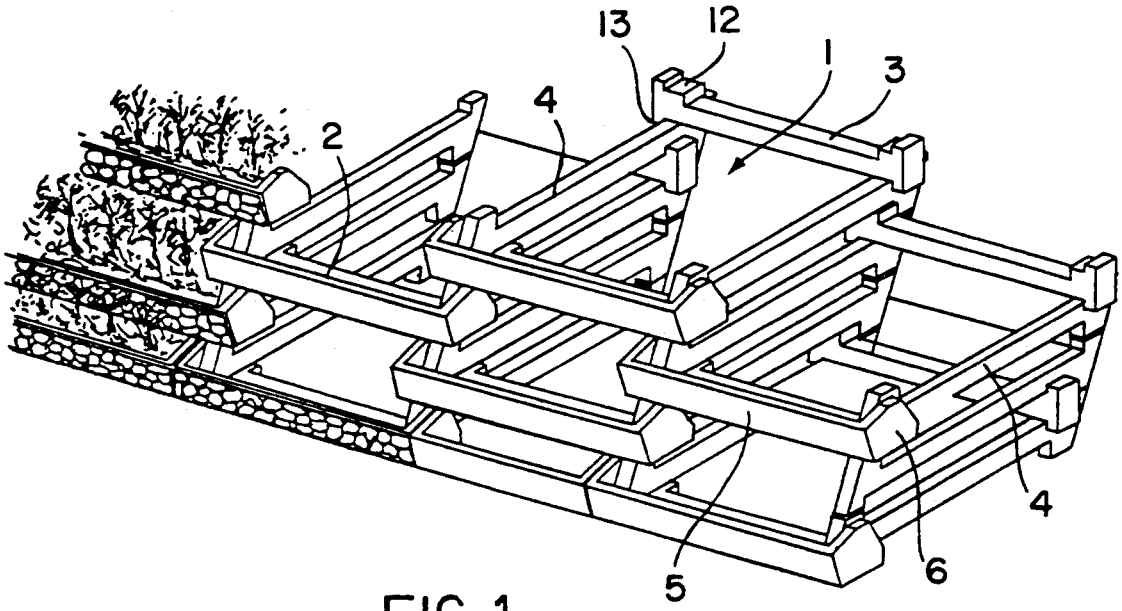
FIG. 1
FIG. 2
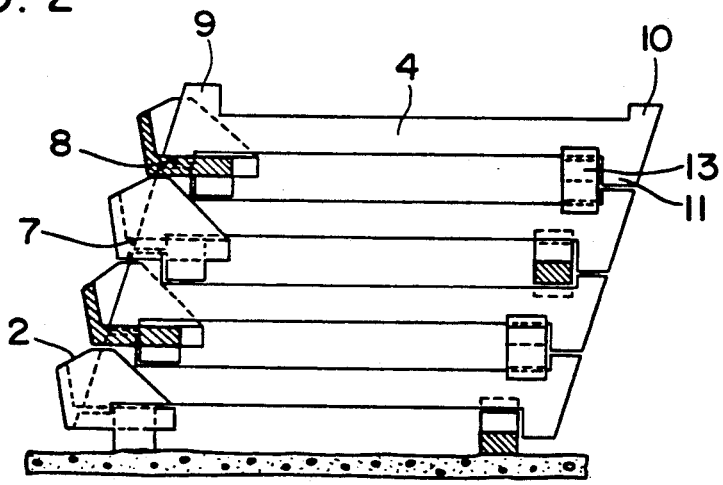

STRUCTURE TO CONTAIN NATURAL AND/OR ARTIFICIAL EMBANKMENTS

This invention relates to a structure for the containment of natural and/or artificial embankments.

More particularly, this invention relates to a structure of the type mentioned above, which operates statically on the so-called "gravity walls" principle, and is made up substantially of a succession of modular members along the three dimensions, which members are of a particular shape and inside which the loose filling material is arranged.

Supporting structures consisting of reinforced concrete prefabricated members are built at present by means of some different techniques.

One of the solutions adopted which is known as the "TENSITER" type wall, is made up of a succession of full-height modular boards, said boards being made up of reinforced concrete and being prefabricated in the yard. Such boards form the only erected portion of the supporting structure while the foundations of the wall are realized by means of reinforced concrete and, if necessary, even on piles. The boards are of the "smooth" or of the "rib stiffened" type according to the heights required, while the connection between the foundation (the plinth), the pour and the prefabricated boards is realized through some suitable steel devices which are partly prearranged in the foundation itself and partly on the board.

The static scheme of such type of structure is the so-called "cantilever" scheme, with range of employment up to heights of 9–10 m.

This kind of structure is efficient from the static viewpoint, but it raises problems as regards its insertion in the environment, said problems being comparable to those occurring with pours consisting of reinforced concrete walls.

This kind of solution gives operatively the advantage of avoiding the considerable carpentry works needed for the pours consisting of reinforced concrete erected parts, but it gives remarkable problems in the assembling step because of the very strict tolerances allowed by prefabricated members, especially under non-linear plano-altimetric conditions, as for instance longitudinal slopes, circular curves, plano-altimetric connections and so on, which conditions are generally very frequent in applications.

A second kind of structure that is called "TERRA ARMATA" ("reinforced earth") is made up of a downward facing consisting of prefabricated members of limited sizes, said members consisting of vibrated reinforced concrete of limited thickness and being piled on one another so as to build up the vertical wall. Each member is connected to the embankment lying behind by means of zinc-coated steel tie bars which are introduced into the embankment itself so as to realize the required counteracting force by friction. Accordingly, the supporting structure is to be constructed layerwise so that the required tie bars can be arranged within the erected structure in each layer of the same.

The realization of such structure thus gives rise to a number of remarkable constraints, such as a reduced working speed due to the spreading and compacting of the erected part for which a soil of suitable grain sizes is to be employed in order to obtain a good friction between the steel part and the soil itself; the possibility of adopting such structure just as a supporting structure or for the function of a partial toe wall, as the structure requires an artificial erected portion lying behind for anchoring the tie bars; the impossibility of employing the structure on compressible grounds, as the static scheme does not allow deformations and especially differential settlements of substructures to be absorbed; and the need for a series of special members for realizing the connections and the various singular points that characterize all supporting structures.

From the environmental standpoint, this structure has been widely employed for supporting purposes in urban areas. On the contrary, its application in extra-urban areas is possible just in some limited cases because the final erected structure is fully visible and consists of a vertical reinforced concrete wall like traditional walls, even though it is characterized by a pleasant variated pattern due to the connections between the various single boards.

Moreover, some prefabricated structures made up of vibrated reinforced concrete are also realized, which are called "cellular walls", of modular type which are overlapped to one another and form the containment cells that become next filled with all-in aggregate whose granulometry is very coarse.

The geometry of the members of such system do not allow the adoption of fine granulometry materials for filling because said material would escape out of the horizontal and vertical openings in the outside wall of the cell which are of sizes larger than 4–5 cm. The front wall, that can also be of a sloping configuration, is always planar and hence it lacks surfaces which can be intended for growing grass.

From the static viewpoint, a good static behaviour is obtained up to 9.00–10.00 m, but on soils endowed with good bearing power only.

Such structures are employed as an alternative to the traditional "cage-like structures", in which the metallic net envelope is substituted with a reinforced concrete grid.

A final type of solution adopted is the solution consisting of concrete prefabricated structures like the "CRIBB WALL" or "BIOMURI", which are overlapped so as to realize stack-like containment cells which are then filled with loose material.

By arranging variously the geometry of the members, a downward facing can be obtained which offers various possibilities as regards the growing of grass so that the structure can be well integrated with its environment.

Such technology is employed for realizing "sound proofing" barriers which are very efficient but are not valid from the static viewpoint other than in the case of very limited thrust levels because the reinforced concrete members making up the structure are not tightly connected to one another either horizontally or vertically, and in addition the filling soil cannot be compacted in a suitable way.

Such structures are thus employed as supporting works of less importance, while their employment is mainly in the field of finishing works or of sound proofing on the edge of slopes.

Such brief description of the technologies adopted at the present time puts into evidence that each one of them privileges a particular aspect, i.e., the environmental impact rather than the containment efficiency or rather than the sound proofing, and so on, but no one of such technologies supplies a good solution for the other aspects.

In that context, it is well evident that there is the need for a structure like that suggested according to the present invention, which has been so conceived and realized as to form a structure which is valid both statically and geotechnically, and which is endowed with aesthetic characteristics that make its introduction into the environment easier, as it allows the wall to be almost completely employed for growing grass.

Moreover, the structure according to the present invention is endowed with such functional features as to avoid completely the need for a building yard, to be installed rapidly, to allow the finished wall to be employed immediately, and to have the geotechnical validity even in soils of various compressibility.

Further by means of the solution suggested by the present invention, the vibrated reinforced concrete components can be produced in the yard, so that the optimal qualitative warranty is obtained.

Finally, the structure has been designed to have a system of maximum flexibility, as both small size and large size structures can be realized, with the maximum adaptability to particular plano-altimetric conditions and an optimal environmental introduction.

These and other results are obtained according to the present invention by the realization of a structure consisting of a succession of modular envelopes along the three dimensions (height, width and longitudinal dimension), said structure being made up of a lattice of modular, vibrated reinforced concrete component members, inside which the filling material is placed.

Accordingly, it is a specific object of the present invention to provide a structure for the containment of natural and/or artificial embankments, said structure being made up of a plurality of modular envelopes, each one of said envelopes consisting of a tub-like fore member, whose fore wall is at a slope with respect to the vertical direction; of two transverse members provided with fore hammer-like members, i.e., a lower hammer-like member and an upper hammer-like member, which members couple with a suitable seat realized in the side walls of said tub-like member belonging to the same envelope and an adjacent envelope; and of a back longitudinal member having on its side ends hammer-like members for coupling to corresponding hammer-like members provided at the back part on the transverse members of the envelope to which said member belongs or of the adjacent upper envelope.

More particularly, all members which form the single modular envelopes of the structure according to the present invention can be realized employing vibrated reinforced concrete.

An outer coating consisting of a natural stone quarried locally can be provided on the sloping fore wall of said tub-like members.

Said fore wall of the tub-like member can be 25–45 cm high and a slope between 10 and 20 grad.

Moreover, again according to the present invention the ratio of the surface on which grasses can be grown to the surface of the sloping fore wall can vary in the range from 70 and 80%, so that the surface of the wall itself is 15–35% of the outer front elevation of the whole structure.

Preferably, on the transverse member the lower hammer-like member will be realized at a fore position with respect to the upper hammer-like member, both in the case of the fore hammer-like members and in the case of the back hammer-like members.

The configuration of said hammer-like members of the transverse member is very important because it constraints the design of the structure in terms of slope.

This invention will be disclosed in the following according to some preferred embodiments of the same with particular reference to the figures of the enclosed drawings, wherein:

FIG. 1 is an axonometric view of the structure according to the present invention;

FIG. 2 is a vertical cross-sectional view of the structure shown in FIG. 1;

Figure 3:
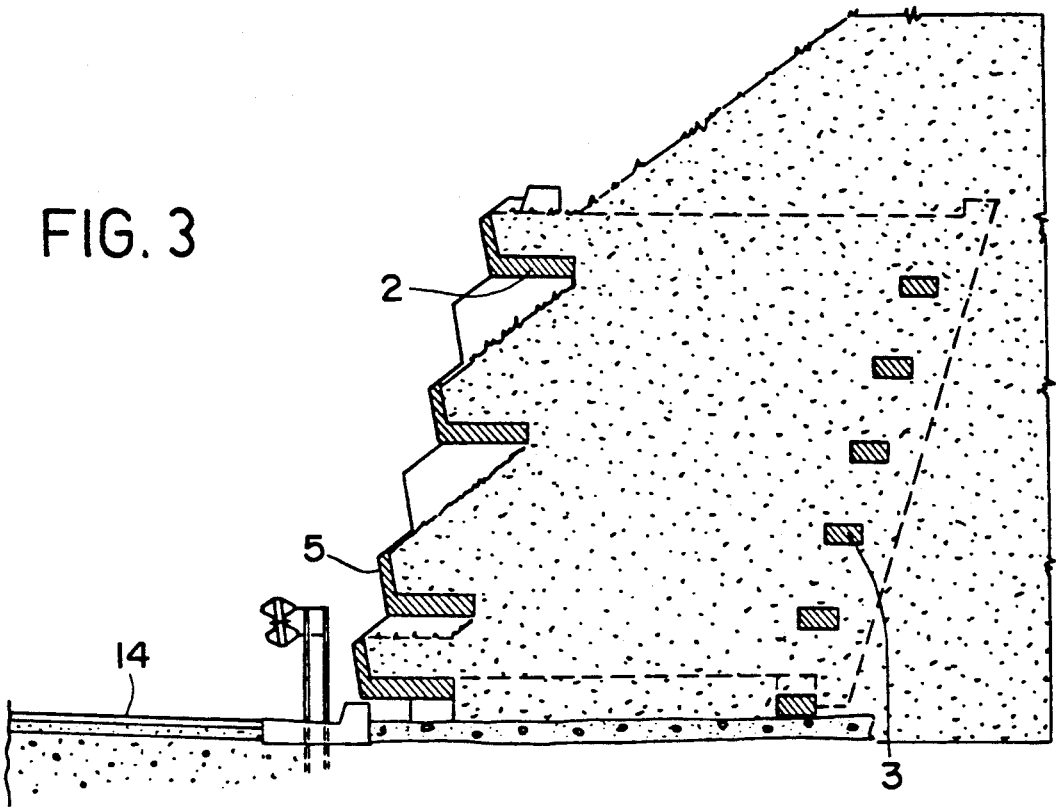
FIG. 3 is a vertical cross-sectional view of a first application of the structure according to the present invention.
Figure 4:
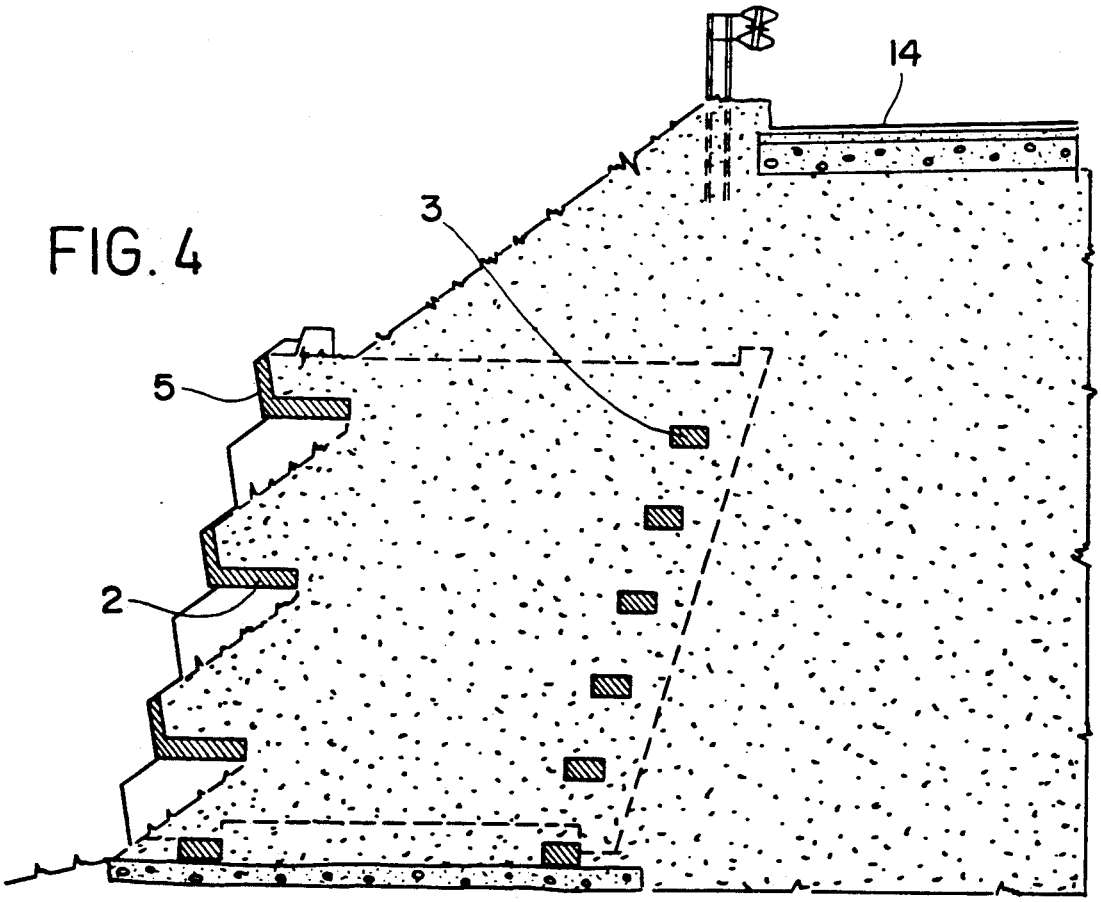
FIG. 4 is a vertical cross-sectional view of a second application of the structure according to the present invention.

With particular reference now to FIGS. 1 and 2, it can be observed that the structure according to the present invention is made up of a plurality of modular envelopes 1, which are equal to one another as regard height, width and longitudinal development.

Each one of said modular envelopes is made up of a tub-like longitudinal member 2, of a longitudinal back member 3, and of two transverse members 4 as well.

Said tub-like members 2, which make up the outside wall of the envelope 1, have their fore wall 5 sloping forward with respect to the vertical direction, and, on the side walls 6, they have seats 7 for realizing the coupling with corresponding lower hammer-like members which are realized on said transverse members 4.

Again into said seat 7 of the side wall 6 the upper hammer-like member 9 of said transverse member 4 belonging to the underlying envelope 1 is introduced to realize the coupling.

As the upper hammer-like member 9 is at a back position with respect to the lower hammer-like member 8, the coupling between the various envelopes occurs along a previously determined direction.

Said transverse member 4 also has two hammer-like members 10 and 11, i.e. an upper and a lower hammer-like member, at the back position for realizing the coupling with the back longitudinal member 3 of the envelope 1 to which it belongs as well as with that of the underlying envelope.

In that case also, the upper hammer-like member 10 is located at a back position with respect to the lower hammer-like member 11.

The member 3 has in turn the shaped portions 12 and 13 at its ends for realizing the coupling with said members 4 of the envelope 1 to which it belongs and with those of the adjacent envelopes 1.

Obviously, as already mentioned above, both the slope and the height of said wall 5 of the member 2 can be varied, and the ratio of the grass-bearing surface to the wall 5 as well as the geometry of the members 3 and 4 can be varied depending on the specific application of the structure according to the present invention.

By filling the envelopes 1 with soil for growing grass as shown in the drawings, the complete covering of the vibrated reinforced concrete structure is obtained.

Accordingly, it is possible to realize supporting structures of heights up to 10.000 m, with the so-called "visible wall" almost totally covered with grass and plants so that it can be easily introduced into the environment of any urban or extraurban area. This is possible because said visible wall turns out to be made up of successive stepwise levels in which the filling soil takes a slope of ⅔ (33°) which is widely compatible with the intrinsic geomechanical characteristics of the filling soil and is thus esposed to the atmospheric agents, and a durable and safe taking root of the vegetable parts is also allowed.

Moreover, the wall 5 of said member 2 can be improved from an environmental standpoint by covering said wall with a local natural stone (see FIG. 1).

The structure according to the present invention can be employed as a "counterscarp" (see FIG. 3) for supporting a natural slope upward of the roadway 14.

Otherwise, said structure can be employed as a "toe wall", for supporting artificial slopes at the bottom of the roadway 14.

Figure 5:
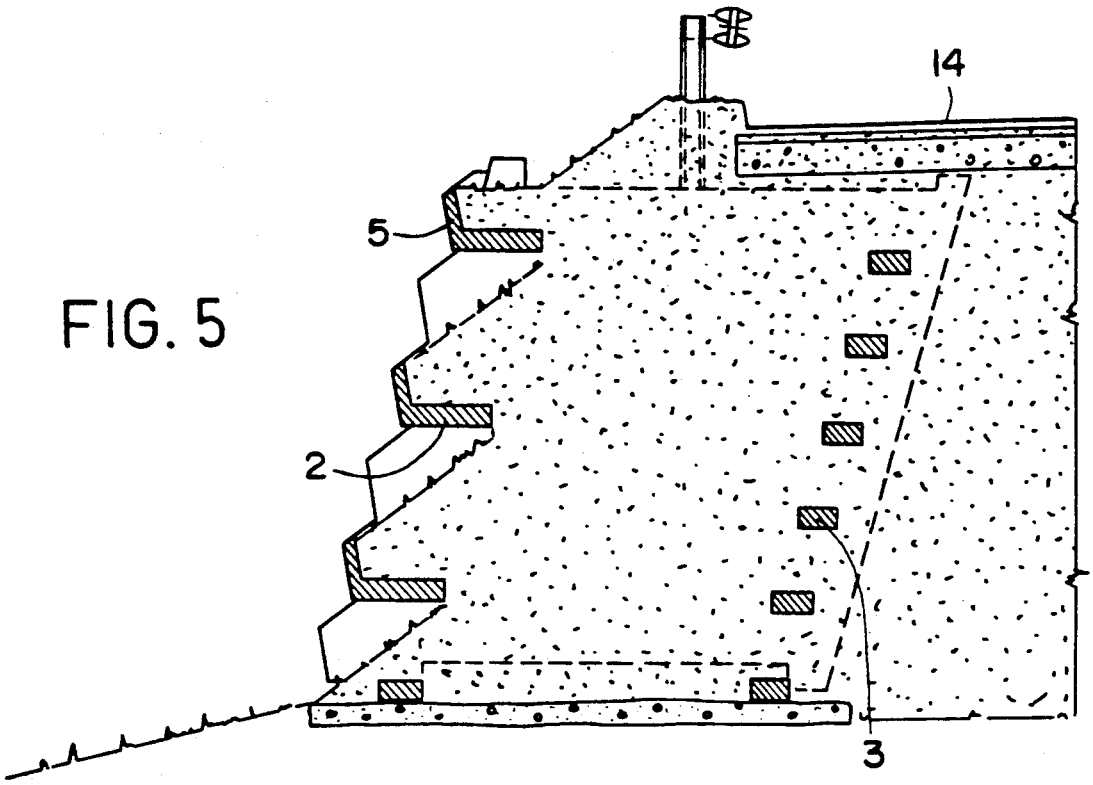
FIG. 5 is a vertical cross-sectional view of a third application of the structure according to the present invention.

A further application is that shown in FIG. 5, wherein the structure realizes a supporting wall to reinforce the body of the roadway 14.

Figure 6:
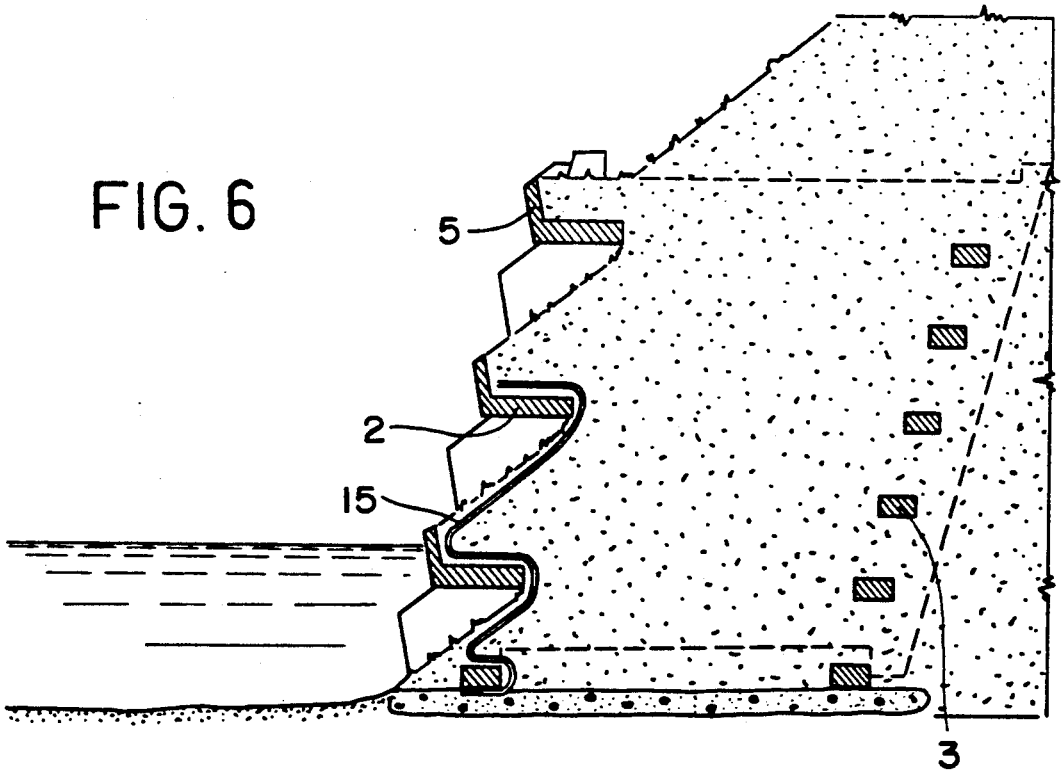
FIG. 6 is a vertical cross-sectional view of a fourth application of the structure according to the present invention.

However, the structure according to the present invention can be advantageously employed as a bank side defence (see FIG. 6).

In that case, a coating net 15 of polyethylene or of any other material is arranged between the single members 2 which allows grasses to take root, as well as to grow and to keep also in case of river flood.

This invention has been disclosed with particular reference to some preferred embodiments of the same, but it is to be understood that modifications and/or changes can be introduced in the disclosure by those who are skilled in the art without departing from the actual spirit and scope of the same for which a priority right is claimed.

I claim:

1. A structure for the containment of natural and/or artificial embankments, comprising a plurality of modular envelopes (1) made up of a fore tub-like longitudinal member (2) having a fore wall (5) at slope with respect to the vertical direction, two transverse members (4), provided with fore and back hammer-like members, and a back longitudinal member (3); said structure being characterized in that each of said fore tub-like members has two side walls (6) and upper and lower seats (7); each of said back longitudinal members (3) has at its ends upper (12) and lower (13) shaped coupling portions; and each of said transverse members (4) has fore upper (9) and lower (8) hammer-like members for coupling with said lower and upper seats (7) of the fore tub-like members of adjacent overlying and underlying ones of said modular envelopes, and has back upper (10) and lower (11) hammer-like members for coupling with said lower (13) and upper (12) shaped coupling portions of said back longitudinal members (13) of adjacent overlying and underlying ones of said modular envelopes.

2. A structure according to claim 1, wherein all of said members comprising each modular envelope are made up of vibrated reinforced concrete.

3. A structure according to claim 1, wherein said fore sloping wall of said tub-like members is coated externally with a local natural stone.

4. A structure according to claim 1, wherein said fore wall of said tub-like member is of a height ranging from 25 to 45 cm and of a slope ranging from 10 to 20 grad.

5. A structure according to claim 1, wherein said modular envelopes are filled with soil providing a planting surface, the ratio of the planting surface so obtained to the fore sloping wall ranging from 70 to 80%, while the surface of the wall itself corresponds to a value of 15–35% of the outer front elevation of the whole structure.

6. A structure according to claim 1, wherein said lower hammer-like member on each of said transverse members is at a fore position with respect to said upper hammer-like member, both in the case of said fore hammer-like members and in the case of said back hammer-like members.

7. A structure for the containment of natural and/or artificial embankments, comprising a plurality of adjacent underlying and overlying modular envelopes, each envelope being formed by:

a longitudinal tub-like front member having a fore wall, a bottom wall, a pair of side walls at the opposite ends of the fore wall and bottom wall, and upper and lower seats at each of the side walls;

a longitudinal back member having opposite end walls, and upper and lower coupling portions adjacent each of the end walls; and two transverse members, each transverse member having a front end and a rear end provided respectively with front lower and upper hammer-like members and with rear lower and upper hammer-like members, said front lower and upper hammer-like members respectively having coupling engagement in an upper seat of the front member of the modular envelope formed by the transverse member and in the lower seat of the front member of an adjacent overlying modular envelope, said rear lower and upper hammer-like members respectively having coupling engagement with an upper coupling portion of the back member of the modular envelope formed by the transverse member and with a lower coupling portion of the back member of an overlying modular envelope.

8. A structure according to claim 7 wherein said modular envelopes are arranged in adjacent generally vertically extending rows, successive modular envelopes in one row being separated by one of said transverse members of a modular envelope in each row adjacent to said one row.

9. A structure according to claim 8 wherein each of said transverse members has said front lower hammer-like members positioned forwardly of said front upper hammer-like member, and said rear lower hammer-like member positioned forwardly of said rear upper hammer-like member whereby each of said underlying modular envelopes in one of said rows is located forwardly of the overlying modular envelopes in each adjacent row.

10. A structure according to claim 9 wherein said fore wall of said tub-like member has a forward slope with respect to the vertical direction.

* * * * *